US007537135B2

(12) United States Patent
Luce et al.

(10) Patent No.: US 7,537,135 B2
(45) Date of Patent: May 26, 2009

(54) MEASURED QUANTITY BEVERAGE DISPENSER

(75) Inventors: Nicola J. Luce, Londonderry, NH (US); Richard Stinchfield, Salem, NH (US); Douglas B. Waterman, Salem, NH (US); Jonathan Marks, Somervlle, MA (US); David A. McDonald, Merrimack, NH (US)

(73) Assignee: Power Delivery Beverage Systems LLC, Londonderry, NH (US)

( * ) Notice: Subject to any disclaimer, the term of this patent is extended or adjusted under 35 U.S.C. 154(b) by 776 days.

(21) Appl. No.: 11/104,841

(22) Filed: Apr. 12, 2005

(65) Prior Publication Data

US 2006/0226161 A1 Oct. 12, 2006

(51) Int. Cl.
*B65D 25/14* (2006.01)

(52) U.S. Cl. ..... 220/737; 222/105

(58) Field of Classification Search ..... None
See application file for complete search history.

(56) References Cited

U.S. PATENT DOCUMENTS 3,682,175 A * 8/1972 Halter ..... 604/184
5,370,282 A * 12/1994 Sedlmeier ..... 222/391

OTHER PUBLICATIONS

Notification Concerning Transmittal Of Copy Of International Preliminary Report On Patentability (Chapter 1 Of the Patent Cooeration Treaty) and Written Opinion Of The I.S.A.

* cited by examiner

*Primary Examiner*—Stephen J. Castellano

(57) ABSTRACT

A measured quantity beverage dispenser that allows for numerous uses simply by replacing a disposable pouch or cartridge prefilled with a specific quantity of beverage. The measured quantity beverage dispenser efficiently and effectively delivers beverage to an end user by maintaining constant pressure within the disposable pouch. The measured quantity beverage dispenser further prevents accidental leaking or dispensing of beverage.

3 Claims, 3 Drawing Sheets

MEASURED QUANTITY BEVERAGE DISPENSER

BACKGROUND OF THE INVENTION

1. Field of the Invention

The present invention relates generally to beverage containers and dispensers. More particularly, the present invention relates to beverage dispensing devices that allow for multiple uses and dispense a predetermined quantity of liquid.

2. Description of Related Art

The human body needs to intake two quarts of fluid per day, but the human body can lose up to two quarts of fluids per hour in an active workout. The human body, however, can only intake twenty-four ounces of fluid per hour (eight ounce increments ever twenty minutes) in order to maintain productivity at an optimum level. Any more or less than this amount slows down the human body's productivity and puts the brain into a fatigued mode. People rarely supplement the human body correctly for the loss of fluids or replenishment of fluids needed for the human body to function in its best mode, especially during an active workout.

Packages and bottles for containing and dispensing fluids are well known. Plastic bottles, aluminum cans, and paper boxes are commercial standards for providing users with premeasured quantities of a beverage. Users, however, do not have the option of reusing these commercial containers to redispense premeasured quantities of beverages. Water bottles are recycled countless times to contain and dispense preferred quantities of a beverage. Users, however, must measure out for themselves quantities of the beverage to be dispensed. Often times, the quantities measured out by users are not precise.

Another problem with known containers and dispensers is the inability to provide adequate pressure to dispense the beverages quickly and efficiently to the users. Users often must tip or tilt containers and dispensers in order properly dispense beverages. Users may also have to compress containers and dispensers in order to create enough pressure within the walls of the containers and dispensers to properly dispense the beverages.

Many commercial containers and water bottles have design or manufacturing flaws that allow for accidental leaking or dispensing of the beverage. Not only is this messy and inconvenient for the users, but it also decreases the amount of beverage available to the user to consume.

What is needed is a dispensing system that will easily dispense an appropriate measured quantity of a beverage to allow a user to maintain an appropriate level of bodily fluids in accordance with the absorption capabilities of the human body, especially during an active workout. The dispensing system should maintain constant pressure within the containing vessel in order to efficiently and effectively deliver the beverage to the user. This dispensing system should also be able to prevent accidental leaking or dispensing of the beverage.

OBJECTS OF THE INVENTION

It is an object of the present invention to solve the problems discussed above pertaining to containing and dispensing measured quantities of a beverage. Specifically, it is an object of the present invention to provide a measured quantity beverage dispenser that allows for numerous uses by replacing a disposable pouch or cartridge that is prefilled with a specific quantity of the beverage. The present invention provides a user with an efficient delivery of a measured quantity of a beverage, because of constant pressure being maintained within the walls of the disposable pouch or cartridge. The ease of use of the present invention allows the user to maintain optimal hydration without having to interrupt his or her activities. The present invention further decreases the likelihood of the accidental leaking or dispensing of beverage that is associated with many commercial containers and water bottles.

SUMMARY OF THE INVENTION

One embodiment of the present invention relates to a measured quantity beverage dispenser comprising: a rigid, reusable vessel; a trigger attached to the rigid, reusable vessel; a mouthpiece attached to the rigid, reusable vessel; a bottom hatch attached to the rigid, reusable vessel; and a nonrigid, disposable pouch for containing a measured quantity of beverage. The trigger further comprises a lever. The nonrigid, disposable pouch further comprises a rigid draw tube connector. The measured quantity beverage dispenser further comprises means for opening and closing the bottom hatch in order to allow a user to insert and remove the nonrigid, disposable pouch.

The mouthpiece comprises an upper dispensing portion, a lower dispensing portion, and a spring as a component of both the upper and lower dispensing portions. The upper dispensing portion further comprises an opening to allow beverage to be dispensed to the user. The lower dispensing portion is pivotally coupled to and upwardly depending on the lever of the trigger. The mouthpiece further comprises a rigid draw tube, connected to the upper dispensing portion, for piercing and drawing beverage from the nonrigid, disposable pouch. The mouthpiece further comprises a mouthpiece cap pivotally mounted for covering the opening of the upper dispensing portion to prevent accidental dispensing and for uncovering the opening of the upper dispensing portion to allow the beverage to be dispensed to the user.

In this embodiment, the user opens the bottom hatch and inserts the nonrigid, disposable pouch into the rigid, reusable container body. The user then closes the bottom hatch to secure the nonrigid, disposable pouch inside the rigid, reusable container body. The rigid draw tube of the mouthpiece connects to the rigid draw tube connector of the nonrigid, disposable pouch; and at the same time, the rigid draw tube of the mouthpiece pierces the nonrigid, disposable pouch. Vacuum pressure inside the nonrigid, disposable pouch forces the beverage into the space located between the upper and lower dispensing portions. The user moves the mouthpiece cap from a covering position to a position uncovering the opening of the upper dispensing portion to allow the beverage to be dispensed to the user. The user then compresses the trigger. The lever of the trigger pushes the lower dispensing portion upward. The spring compresses, and the upper and lower dispensing portions contract to dispense the beverage through the opening of the mouthpiece. When the upper and lower dispensing portions expand, more beverage is forced into the space located between the upper and lower dispensing portions because vacuum pressure is maintained inside the nonrigid, disposable pouch due to the collapsing walls of the nonrigid, disposable pouch.

Another embodiment of the present invention relates to a measured quantity beverage dispenser comprising: a rigid, reusable vessel; a trigger attached to the rigid, reusable vessel; a mouthpiece attached to the rigid, reusable vessel; a bottom hatch attached to the rigid, reusable vessel; and a nonrigid, disposable pouch for containing a measured quantity of a beverage. The trigger further comprises a lever. The bottom hatch further comprises a needle for piercing and drawing beverage from the nonrigid, disposable pouch. The nonrigid, disposable pouch further comprises a rigid draw tube connector. The measured quantity beverage dispenser further comprises means for opening and closing the bottom hatch in order to allow a user to insert and remove the nonrigid, disposable pouch.

The mouthpiece comprises an upper dispensing portion, a lower dispensing portion, and a spring housed between the upper and lower dispensing portions. The upper dispensing portion further comprises an opening to allow the beverage to be dispensed to a user. The lower dispensing portion is pivotally coupled to and upwardly depending on the lever of the trigger. The mouthpiece further comprises a rigid draw tube running along the inner wall of the rigid, reusable vessel to the needle of the bottom hatch. The mouthpiece further comprises a mouthpiece cap pivotally mounted for covering the opening of the upper dispensing portion to prevent accidental dispensing and for uncovering the opening of the upper dispensing portion to allow the beverage to be dispensed to the user.

In this embodiment, the user opens the bottom hatch and inserts the nonrigid, disposable pouch into the rigid, reusable container body. The user then closes the bottom hatch to secure the nonrigid, disposable pouch inside the rigid, reusable container body. The needle of the bottom hatch connects to the rigid draw tube connector of the nonrigid, disposable pouch; and at the same time, the needle of the bottom hatch pierces the nonrigid, disposable pouch. Pressure inside the nonrigid, disposable pouch forces beverage through the rigid draw tube and into space located between the upper and lower dispensing portions. The user moves the mouthpiece cap from a covering position to a position uncovering the opening of the upper dispensing portion to allow the beverage to be dispensed to the user. The user then compresses the trigger, and the lever of the trigger pushes the lower dispensing portion upward. The spring compresses, and the upper and lower dispensing portions contract to dispense beverage through the opening of the mouthpiece. When the upper and lower dispensing portions expand, more beverage is forced into the space located between the upper and lower dispensing portions because vacuum pressure is maintained inside the nonrigid, disposable pouch due to the collapsing walls of the nonrigid, disposable pouch.

Another embodiment of the present invention relates to a measured quantity beverage dispenser comprising: a rigid, reusable vessel; a trigger attached to the rigid, reusable vessel; a mouthpiece attached to the rigid, reusable vessel; a bottom hatch attached to the rigid, reusable vessel; and a semirigid, disposable cartridge for containing a measured quantity of beverage. The trigger further comprises a lever, and the semirigid, disposable cartridge further comprises a rigid draw tube connector. The measured quantity beverage dispenser further comprises means for opening and closing the bottom hatch in order to allow a user to insert and remove the semirigid, disposable cartridge.

The mouthpiece comprises an upper dispensing portion, a lower dispensing portion, and a spring housed between the upper and lower dispensing portions. The upper dispensing portion further comprises an opening to allow a beverage to be dispensed to the user. The lower dispensing portion is pivotally coupled to and upwardly depending on the lever of the trigger. The mouthpiece further comprises a rigid draw tube, connected to the upper dispensing portion, for piercing and drawing the beverage from the semirigid, disposable cartridge. The mouthpiece further comprises a mouthpiece cap pivotally mounted for covering the opening of the upper dispensing portion to prevent accidental dispensing and for uncovering the opening of the upper dispensing portion to allow the beverage to be dispensed to the user.

In this embodiment, the user opens the bottom hatch and inserts the semirigid, disposable cartridge into the rigid, reusable container body. The user then closes the bottom hatch to secure the semirigid, disposable cartridge inside the rigid, reusable container body. The rigid draw tube of the mouthpiece connects to the rigid draw tube connector of the semirigid, disposable cartridge; and at the same time, the rigid draw tube of the mouthpiece pierces the semirigid, disposable cartridge. Pressure inside the semirigid, disposable cartridge forces beverage into space located between the upper and lower dispensing portions. The user moves the mouthpiece cap from a covering position to a position uncovering the opening of the upper dispensing portion to allow the beverage to be dispensed to the user. The user then compresses the trigger, and the lever of the trigger pushes the lower dispensing portion upward. The spring compresses, and the upper and lower dispensing portions contract to dispense beverage through the opening of the mouthpiece. When the upper and lower dispensing portions expand, more beverage is forced into the space located between the upper and lower dispensing portions because vacuum pressure is maintained inside the semirigid, disposable cartridge due to the collapsing walls of the semirigid, disposable cartridge.

Another embodiment of the present invention relates to a measured quantity beverage dispenser comprising: a rigid, reusable vessel; a trigger attached to the rigid, reusable vessel; a mouthpiece attached to the rigid, reusable vessel; a bottom hatch attached to the rigid, reusable vessel; and a semirigid, disposable cartridge for containing a measured quantity of a beverage. The trigger further comprises a lever, and the bottom hatch further comprises a needle for piercing and drawing the beverage from the semirigid, disposable cartridge. The semirigid, disposable cartridge further comprises a rigid draw tube connector. The measured quantity beverage dispenser further comprises means for opening and closing the bottom hatch in order to allow a user to insert and remove the semirigid, disposable cartridge.

The mouthpiece comprises an upper dispensing portion, a lower dispensing portion, and a spring housed between the upper and lower dispensing portions. The upper dispensing portion further comprises an opening to allow the beverage to be dispensed to the user. The lower dispensing portion is pivotally coupled to and upwardly depending on the lever of the trigger. The mouthpiece further comprises a rigid draw tube, running along the inner wall of the rigid, reusable vessel to the needle of the bottom hatch. The mouthpiece further comprises a mouthpiece cap pivotally mounted for covering the opening of the upper dispensing portion to prevent accidental dispensing and for uncovering the opening of the upper dispensing portion to allow the beverage to be dispensed to the user.

In this embodiment, the user opens the bottom hatch and inserts the semirigid, disposable cartridge into the rigid, reusable container body. The user then closes the bottom hatch to secure the semirigid, disposable cartridge inside the rigid, reusable container body. The needle of the bottom hatch connects to the rigid draw tube connector of the semirigid, disposable cartridge; and at the same time, the needle of the bottom hatch pierces the semirigid, disposable cartridge. Pressure inside the semirigid, disposable cartridge forces beverage through the rigid draw tube and into a space located between the upper and lower dispensing portions. The user moves the mouthpiece cap from a covering position to a position uncovering the opening of the upper dispensing portion to allow the beverage to be dispensed to the user. The user then compresses the trigger, and the lever of the trigger pushes the lower dispensing portion upward. The spring compresses, and the upper and lower dispensing portions contract, to dispense beverage through the opening of the mouthpiece. When the upper and lower dispensing portions expand, more beverage is forced into the space located between the upper and lower dispensing portions because pressure is maintained inside the semirigid, disposable cartridge due to the collapsing walls of the semirigid, disposable cartridge.

DETAILED DESCRIPTION OF THE INVENTION

Figure 1C:
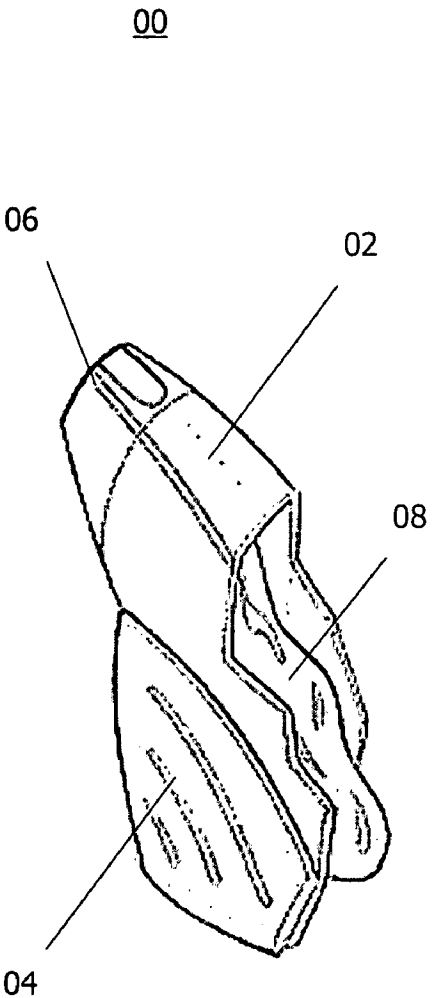
FIGS. 1A, 1B, and 1C show a representative measured quantity beverage dispenser according to an embodiment of the present invention.
Figure 1A:
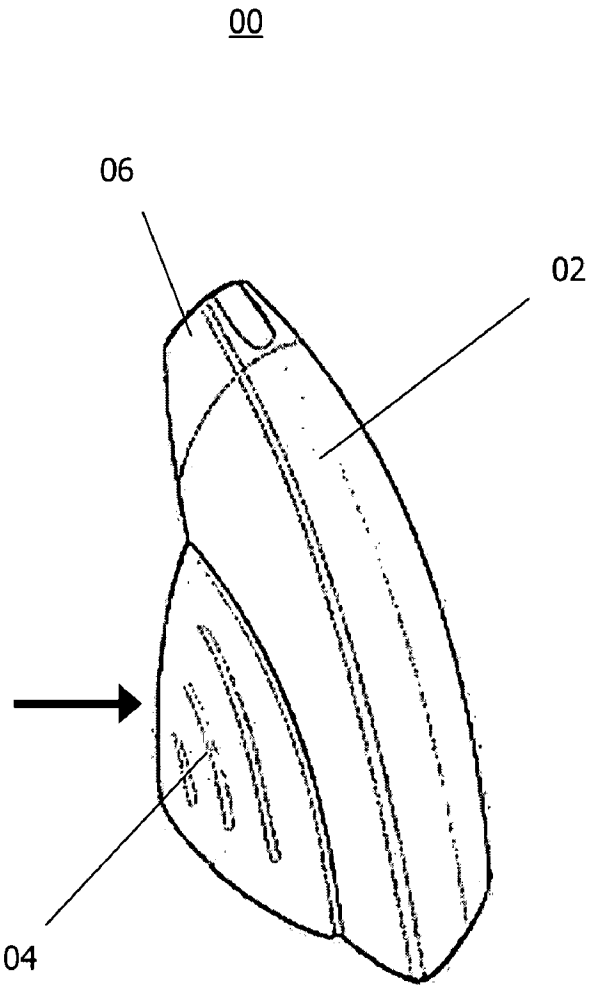
Figure 1B:
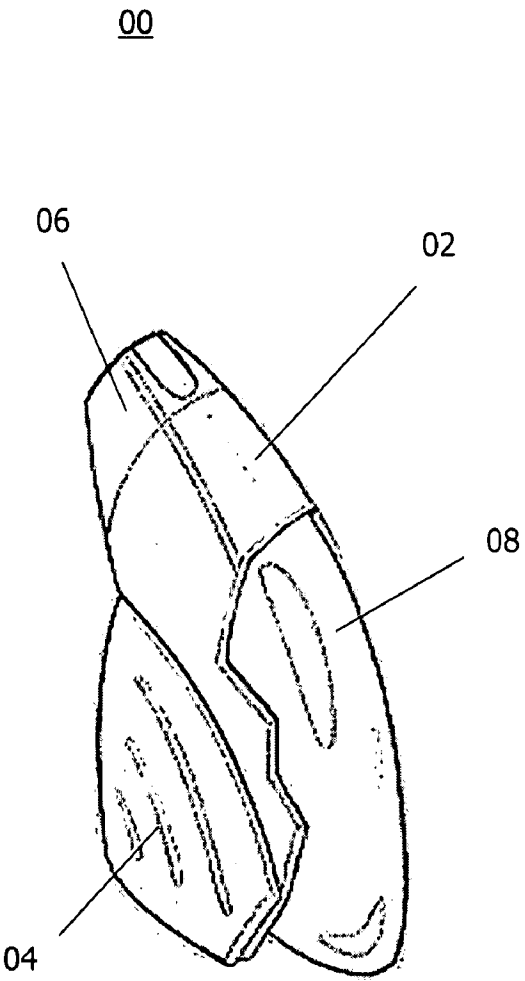

FIGS. 1A, 1B and 1C show a representative measured quantity beverage dispenser 00 according to an embodiment of the present invention. Measured quantity beverage dispenser 00 comprises a rigid, reusable vessel 02; a trigger 04; and a mouthpiece 06. Measured quantity beverage dispenser 00 further comprises a nonrigid, disposable pouch 08 shown in FIGS. 1B and 1C. Nonrigid, disposable pouch 08 further comprises a rigid draw tube connector (not shown).

Nonrigid, disposable pouch 08 is inserted through a bottom hatch (not shown) into the rigid, reusable vessel 02 by a user. A rigid draw tube 20, shown in FIG. 3, pierces and draws the beverage from nonrigid, disposable pouch 08 into the mouthpiece 06. When the user compresses trigger 04, the beverage is dispensed through the mouthpiece 06.

Figure 2C:
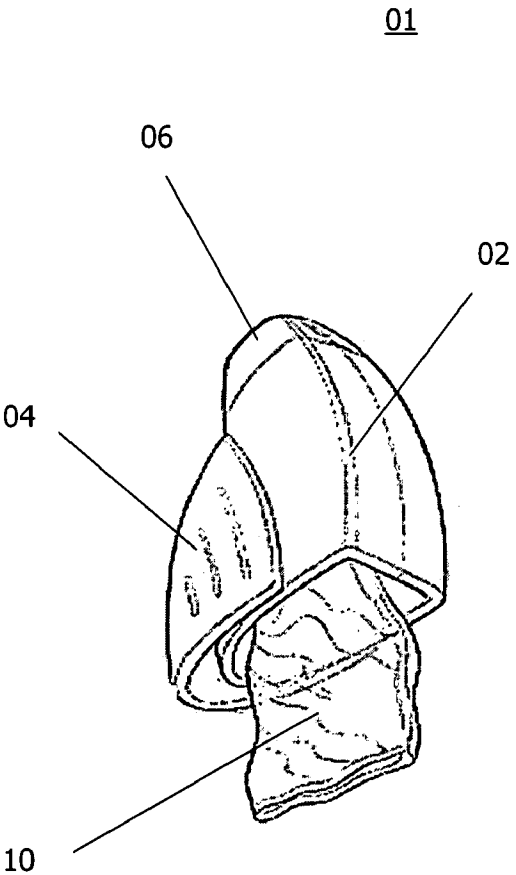
FIGS. 2A, 2B, and 2C show a representative measured quantity beverage dispenser according to another embodiment of the present invention.
Figure 2A:
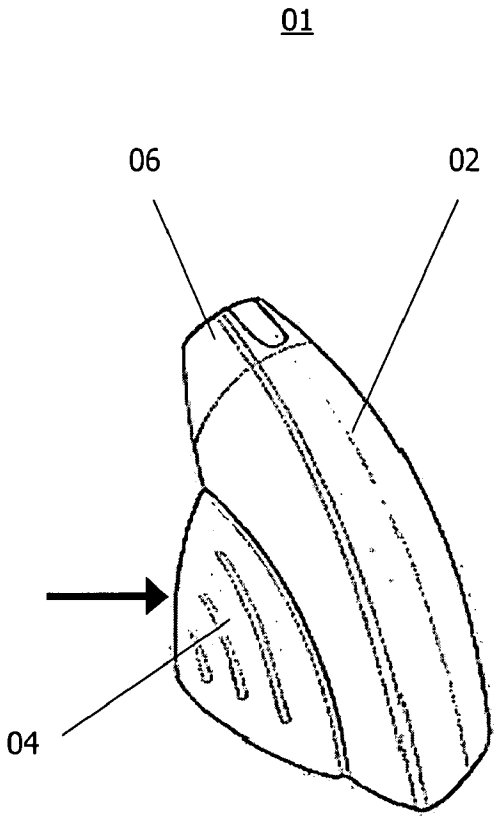
Figure 2B:
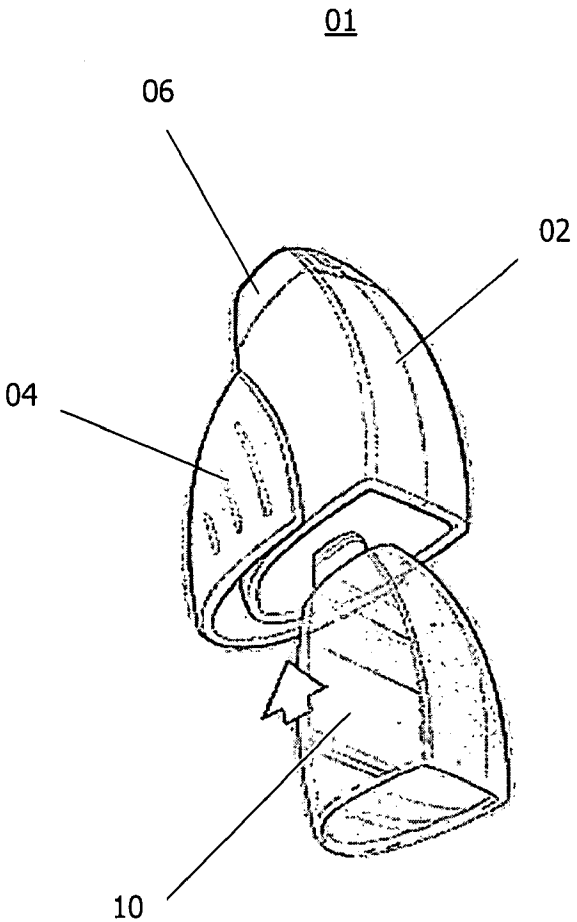

FIGS. 2A, 2B, and 2C show a representative measured quantity beverage dispenser 01 according to another embodiment of the present invention. Measured quantity beverage dispenser 01 comprises a rigid, reusable vessel 02; a trigger 04; and a mouthpiece 06. Measured quantity beverage dispenser 01 further comprises a semirigid, disposable cartridge 10. Semirigid, disposable cartridge 10 further comprises a rigid draw tube connector (not shown).

The semirigid, disposable cartridge 10 is inserted through a bottom hatch (not shown) into the rigid, reusable vessel 02. The rigid draw tube 20, shown in FIG. 3, pierces and draws the beverage from semirigid, disposable cartridge 10 into mouthpiece 06. When the user compresses the trigger 04, the beverage is dispensed through the mouthpiece 06.

Figure 3:
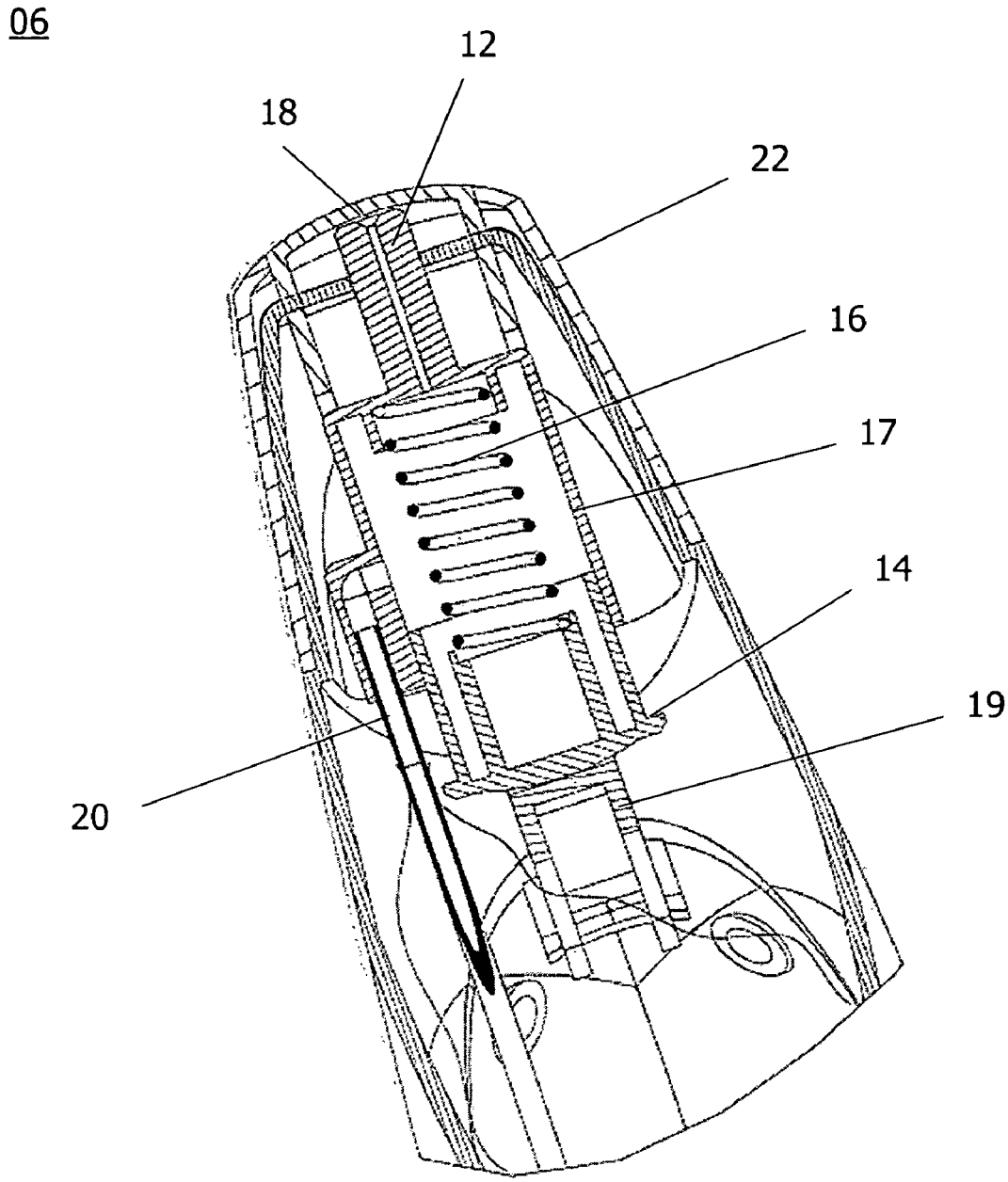
FIG. 3 is a cross-sectional view of a mouthpiece according to an embodiment of the present invention.

FIG. 3 shows the mouthpiece 06 according to the present invention in cross section. Mouthpiece 06 comprises an upper dispensing portion 12, a lower dispensing portion 14, and a compression spring 16. The compression spring 16 is housed between the upper dispensing portion 12 and the lower dispensing portion 14 in a sleeve 17. The upper dispensing portion 12 further comprises an opening 18 to allow the beverage to be dispensed to a user. The lower dispensing portion 14 is pivotally coupled to and upwardly depending on a lever portion 19 of trigger 04 shown in FIGS. 1A-1C and 2A-2C. Mouthpiece 06 further comprises a mouthpiece cap 22 pivotally mounted for covering the opening 18 of the upper dispensing portion 12 to prevent accidental dispensing and for uncovering the opening 18 of the upper dispensing portion 12 to allow the beverage to be dispensed to the user.

The mouthpiece 06 further includes the rigid draw tube 20 that is connected to the upper dispensing portion 12 for piercing and drawing the beverage from either the nonrigid, disposable pouch 08 or the semirigid, disposable cartridge 10 into the space containing the spring 16 and defined by the sleeve 17 between the upper dispensing portion 12 and the lower dispensing portion 14 due to pressure inside the nonrigid, disposable pouch 08 or the semirigid, disposable cartridge 10. Alternatively, the rigid draw tube 20 runs down the inner wall of the rigid, reusable vessel 02 and connects to a needle on the bottom hatch (not shown). The needle pierces and draws the beverage from one of the nonrigid, disposable pouch 08 or the semirigid, disposable cartridge 10 into the space between upper dispensing portion 12 and lower dispensing portion 14 due to pressure inside the nonrigid, disposable pouch 08 or the semirigid, disposable cartridge 10.

When the user compresses the trigger 04, the upper dispensing portion 12 and the lower dispensing portion 14 move toward each other and compress spring 16. The space between the upper dispensing portion 12 and the lower dispensing portion 14 is reduced, causing the beverage to be dispensed from the mouthpiece 06 through the opening 18.

The above invention has been described with specific embodiments, but a person skilled in the art could introduce many variations on these embodiments without departing from the spirit of the disclosure or from the scope of the appended claims. The embodiments are presented for the purpose of illustration only and should not be read as limiting the invention or its application. Therefore, the claims should be interpreted commensurate with the spirit and scope of the invention.

We claim:

1. A beverage dispensing apparatus for dispensing a liquid beverage comprising:

a case defining an internal receptacle volume for receiving a collapsible liquid containing pouch;

a mouthpiece attached to the case and being in fluid communication with the liquid contained in the pouch; and a trigger pivotably attached to the case for actuation by a user and having a lever arranged inside the case for forcing the liquid from the pouch into the mouthpiece when the trigger and case are compressed together in a direction towards each other to pivot the trigger toward the case and internal receptacle volume defined in the case, wherein the mouthpiece includes:

an upper dispensing portion;

a lower dispensing portion pivotally coupled to and upwardly depending on the lever of the trigger;

a volume of space created between the upper and lower dispensing portions defining a volume for holding an amount of beverage;

a spring housed in the space between the upper dispensing portion and lower dispensing portion; and a mouthpiece cap pivotally mounted for covering an opening of the upper dispensing portion to prevent dispensing of the beverage in a covered position and for uncovering the opening of the upper dispensing portion to allow the beverage to be dispensed to the user, whereby actuation of the trigger causes a predetermined portion of the amount of beverage in the volume to be dispensed through the opening.

2. The beverage dispensing apparatus as set forth in claim 1, wherein the mouthpiece further includes a rigid draw tube connected to the upper dispensing portion for piercing and drawing a beverage from the top of the pouch.

3. The beverage dispensing apparatus as set forth in claim 1, wherein the mouthpiece further includes a rigid draw tube connected to the upper dispensing portion and running the length of case for piercing and drawing a beverage from the bottom of the pouch.

* * * * *